US008434797B2

(12) United States Patent
Langer

(10) Patent No.: US 8,434,797 B2
(45) Date of Patent: May 7, 2013

(54) SHUTTER FASTENER SYSTEM AND METHOD OF INSTALLATION

(75) Inventor: Alfred C. Langer, New Milford, CT (US)

(73) Assignee: Norse, Inc., Torrington, CT (US)

( * ) Notice: Subject to any disclaimer, the term of this patent is extended or adjusted under 35 U.S.C. 154(b) by 904 days.

(21) Appl. No.: 12/229,710

(22) Filed: Aug. 25, 2008

(65) Prior Publication Data

US 2010/0043346 A1 Feb. 25, 2010

(51) Int. Cl.
*E05C 3/04* (2006.01)

(52) U.S. Cl.
USPC ..... 292/241; 292/103

(58) Field of Classification Search ..... 292/83, 292/98, DIG. 38, 96, DIG. 73, DIG. 47, 240, 292/242, 101, 103; 49/465; 52/784.1
See application file for complete search history.

(56) References Cited

U.S. PATENT DOCUMENTS 1,513,234 A * 10/1924 Fritsch ..... 292/101
1,692,295 A * 11/1928 Gerard ..... 292/242
1,954,640 A * 4/1934 Loper ..... 160/128
4,507,010 A * 3/1985 Fujiya ..... 403/322.1
6,565,133 B1 * 5/2003 Timothy ..... 292/242

* cited by examiner

*Primary Examiner* — Gary Estremsky
(74) *Attorney, Agent, or Firm* — McCarter & English, LLP

(57) ABSTRACT

A shutter and fastener system comprising a shutter and two or more fastener mechanisms each comprising cooperating latching and anchor devices, one device mounted on an edge portion of the shutter and the other on an adjacent trim portion. The latching device engages the anchor device and exerts a strong pulling force substantially parallel with the surface of the shutter. The anchor device converts a portion of this force to a perpendicular force resulting in firm engagement between the shutter and the trim portion. An installation method comprises the steps of proving a shutter with at least one latching device mounted thereon and a small opening in the shutter aligned with operating means for the device. An anchor device is provided on an adjacent trim portion and the operating means is actuated from inside the shutter though the small opening to secure the shutter in place. A hanger means for the shutter may also be provided and the need for a ladder in an elevated installation is obviated by passing the shutter outwardly through an opening and thereafter actuating one or more latching devices from within the structure.

16 Claims, 4 Drawing Sheets

SHUTTER FASTENER SYSTEM AND METHOD OF INSTALLATION

Hurricane shutters comprising sheets of plywood or more complex metallic or plastic members have in the past been fastened in place by various means ranging from simple nails and screws to complex multi-part fasteners. While generally satisfactory none of the various fastening means has been found completely satisfactory.

Accordingly, it is the general object of the present invention to provide an improved shutter and fastener system which can be installed in position over a window or the like with a minimum expenditure of time and effort and which is of desirably simple construction and yet provides a superior result in securing shutters firmly in position against adjacent trim.

A further object of the invention resides in the provision of a fastener system and a method of shutter and fastener installation which can be carried out without the use of a ladder for elevated windows etc.

A still further object resides in the provision of a one man installation method which can be carried out from the inside of a window or the like.

RELATED PATENTS

U.S. Pat. No. 3,309,115 to Alfred C. Langer, Mar. 16, 1964 entitled MECHANISM FOR REMOVABLY SECURING PANELS discloses fastener mechanisms which may be adapted to use in the present invention as does U.S. Pat. No. 3,844,832 also to Alfred C Lander, Oct. 23, 1967 and entitled FASTENER MEANS. Both patents are hereby incorporated herein by reference.

SUMMARY OF THE INVENTION

In accordance with the present invention and in fulfillment of the foregoing objects, a shutter is provided to cover an opening such as a window, door etc. and has at least two spaced apart edge portions with window trim or the like adjacent thereto. Conventionally, rectangular shutters are of course employed and may be simple sheets of plywood, more complex metallic shutters etc. At least two fastener mechanisms are preferably provided each comprising latching and anchor devices. One device is mounted on an edge portion of a shutter and the other on an adjacent trim portion, four (4) fastener mechanisms usually being provided in a rectangular arrangement when a rectangular shutter is employed. Neither the latching nor the anchor device projects beyond the edge of the shutter when the fastener mechanism is in its unlatched condition. In the latched condition of the mechanism, however, the latching device spans the shutter edge, engages the anchor device and exerts a strong latching force therebetween substantially parallel to the face of the shutter. Further, a means on one of said devices exerts a force perpendicular to the shutter and in the direction urging the shutter firmly against its adjacent trim.

In the preferred form of the invention the perpendicular shutter closing force is derived from the parallel latching force by means on one of the devices which simultaneously converts a portion of the latching force to the desired perpendicular force directed toward the trim of the window or the like.

The fastener mechanisms are preferably of the type disclosed in the aforementioned patents but may vary widely in design and construction. In all cases, however, the fasteners exert a perpendicular force urging the shutter into firm engagement with the trim. Even a slight degree of looseness between a shutter and its adjacent trim may of course result in the shutter being vibrated, torn loose, and blown away by the excessively high winds encountered in a hurricane.

As disclosed in the aforementioned patents and in the present invention the latching device includes a generally S shaped spring-like latching element which in its unlatched condition resides wholly on one side of a shutter edge but which in its latched condition projects outwardly and spans the shutter edge to engage its corresponding anchor device with a strong but resilient locking force parallel to the face of the shutter. An eccentric actuator for the latching element causes a hook at the free end of the S shaped member to first swing down into engagement with the anchor device and then to pull on the device with a resilient retractive force as high as 500 pounds. Conversion of a part of this force to a resultant perpendicular force is accomplished by means of an inclined surface on the anchor device and, more particularly, an inclined internal edge surface of a slotted receiver member for the S shaped latching element/

Preferably, manual operating means for the latching devices are provided on both the front and rear surfaces thereof with conventional sockets presently preferred and shown in the drawings.

The installation method of the invention comprises the steps of providing a shutter with at least one latching device mounted thereon near an edge so as to project beyond the edge in a latching operation. The latching device has a rearwardly exposed manual operating means and the shutter is provided with a small through opening aligned with the operating means. An anchor device on adjacent trim co-operates with the latching device as aforesaid. The shutter is positioned over a window or the like and the operating means is accessed through the small opening from the rear side of the shutter and actuated to cause the device to engage the anchor device and thus secure the shutter in place. As will be apparent a one man procedure may be followed with the installer passing the shutter diagonally outwardly through an open window and then securing the same in place as aforesaid.

This procedure can of course also be followed on elevated windows etc. avoiding the need for a ladder. Finally, for convenience co-operating vertical support means may be provided to hold the shutters temporarily while latching devices are engaged with anchor devices for secure mounting of the shutters.

DESCRIPTION OF PREFERRED EMBODIMENT

Figure 1:
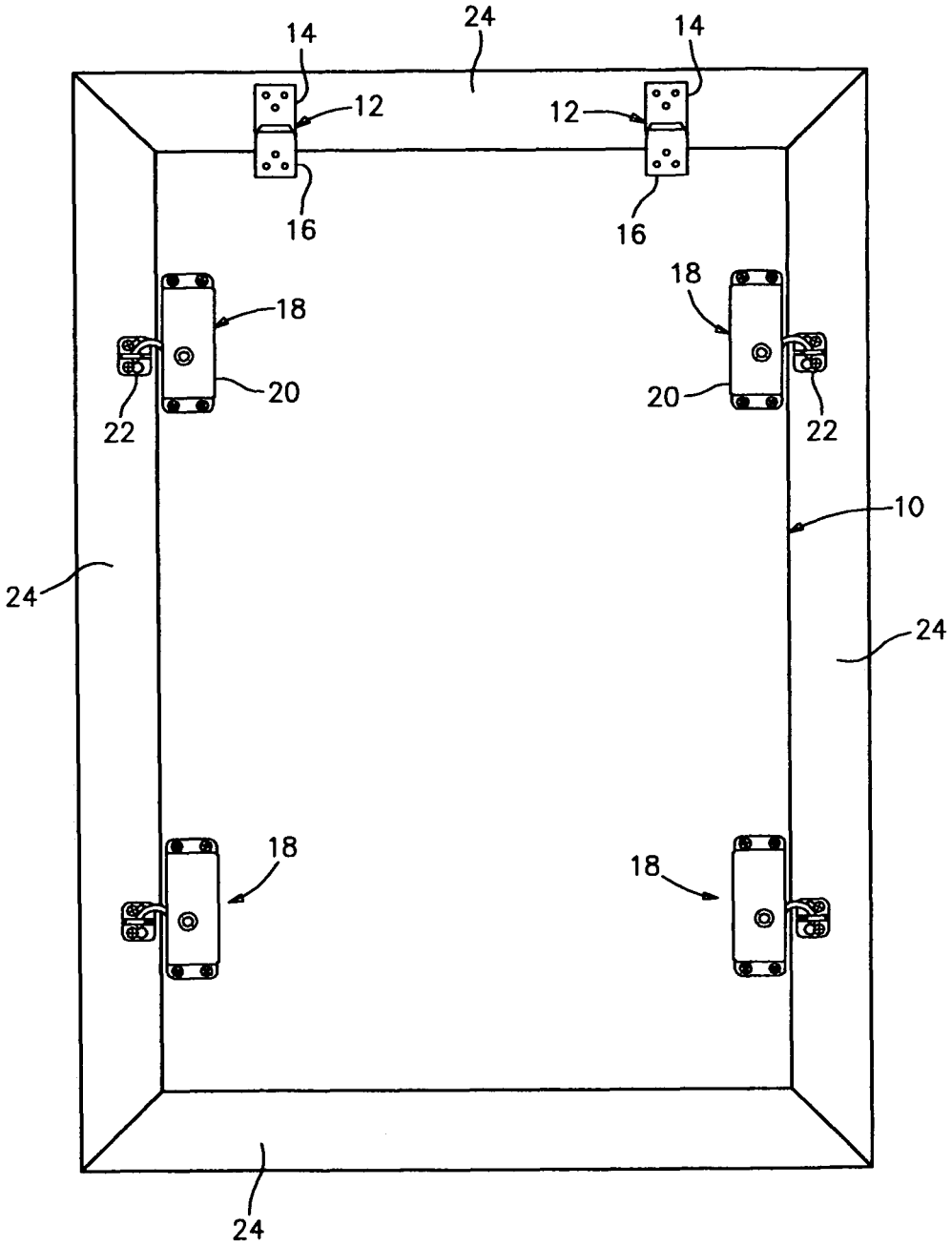
FIG. 1 of the drawings is a somewhat schematic front view of a shutter carrying four (4) latching devices in accordance with the present invention.

Referring particularly to FIG. 1, a hurricane shutter is indicated generally at 10 and may comprise a conventional 4×8 ft. sheet of plywood of appropriate thickness. The shutter is shown supported on co-operative vertical support means 12, 12 which may comprise simple hanger devices with an upper part 14 attached to window trim or the like and a lower part 16, attached to an upper portion of the shutter.

As will be obvious, the shutter 10, can be hung in position from outside the structure on hangers 12, 12 over a window requiring protection from hurricane winds. As will also be obvious, the shutter can be hung from inside the structure with the window open, the shutter being passed outwardly through the window in a diagonal attitude and thereafter held in position by the hangers 12, 12.

Figure 3:
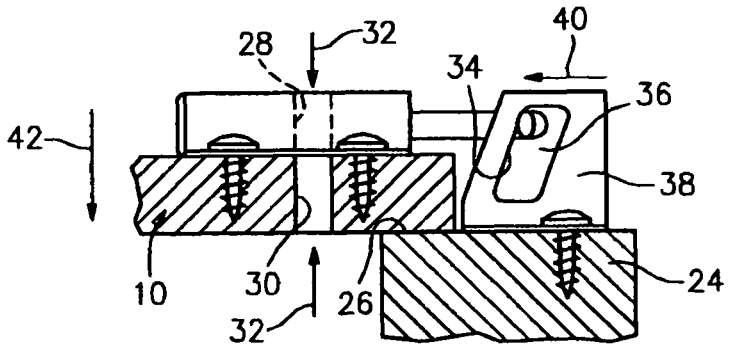
FIG. 3 is an enlarged side view of engaged latching and anchor devices in a surface mounting arrangement.

In accordance with the invention, at least one fastener mechanism is provided for securing the shutter in place. As shown, four (4) fastener mechanisms 18, 18 are shown in a rectangular arrangement corresponding to the corresponding configuration of shutter 10. Each fastener mechanism 18 includes a latching device 20 and an anchor device 22, the former shown mounted on the shutter and the latter on an adjacent trim or frame portion 24 associated with a window or the like. Alternatively, and with a possible reversal of the slot angle in the anchor device, the latching devices 20, 20 may be located on the trim portion 24 with the anchor devices 22, 22 mounted on the shutter. As shown in FIG. 3, a surface mounting arrangement may be employed with the shutter 10 overlapping the trim portion 24 and engaging the outer surface 26 thereof. Alternatively, the shutter 10 can be flush mounted as illustrated in FIG. 4 by providing a small recess such as that shown at 28 or simply fitting the shutter within the frame with small metal or wood stop members provided to establish the appropriate depth of the shutter.

Figure 2:
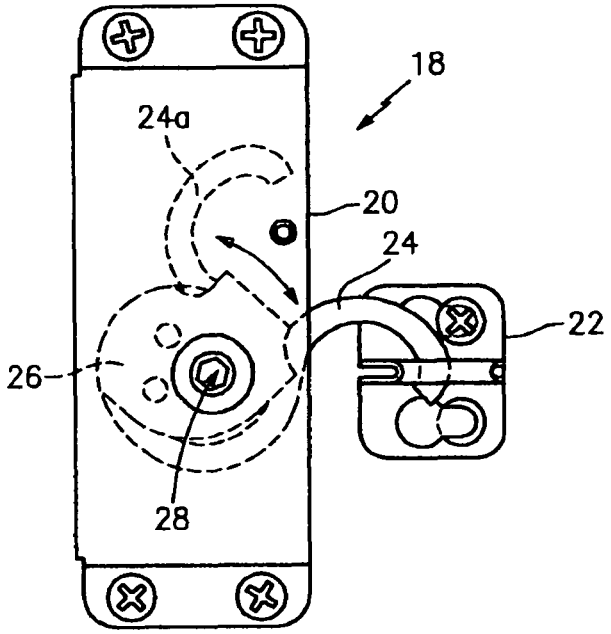
FIG. 2 is an enlarged front view of a single latching device and a single anchor device in a latched condition, the unlatched condition being shown in broken line form.
Figure 4:
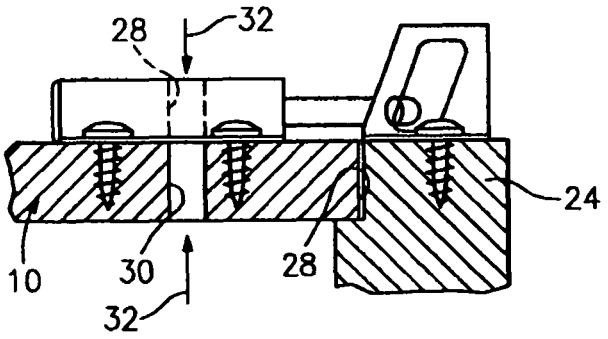
FIG. 4 is an enlarged side view of engaged latching and anchor devices in a flush mounting arrangement.

Referring now to FIGS. 2, 3 and 4 and the aforementioned patents, each fastener mechanism 18 includes a latching device 20 as aforesaid with a generally S shaped latching element 24 of spring metal controlled by an eccentric 26 and an operating means 28 which may be in the form of a conventional hexagonal socket exposed both at the front and rear surfaces of the latching device. A conventional hexagonal operating tool may be provided or, alternatively, a small handle may be provided for manual manipulation. As best illustrated in FIGS. 3 and 4, a small opening 30 provided in the shutter 10 and aligned with the socket 28 accommodates actuation of the socket from the rear of the latching device. Arrows 32, 32 illustrate the multi-directional operation of the latching device. On rotation of the socket 28 in a clockwise direction in FIG. 2, the latching element 24 moves from the broken line retracted position 24*a* to the operative position shown in FIGS. 2-4. In the FIGS. 2-4 position latching element 24 engages an inner surface 34 of a slot 36 in a receiver 38 which forms a part of the anchor device 22. Due to the eccentricity of the element 26, the free end portion of the latching element 24 exerts a retractive or pulling force indicated by the arrow 40 in a direction substantially parallel with the surface of the shutter 10. This force may be in the neighborhood of 500 lbs and the spring characteristics of the latching element compensate for dimensional errors and, more importantly, enables the shutter to withstand heavy vibration caused by the high winds. As aforesaid, the inclined surface 34 in the slot 36 serves to convert a portion of the parallel force 40 to a perpendicular force 42 urging the shutter into firm engagement with the trim portion 24. The slot 36 is dimensioned to accommodate plywood or the like one-fourth to three-fourths of an inch in thickness.

Figure 5:
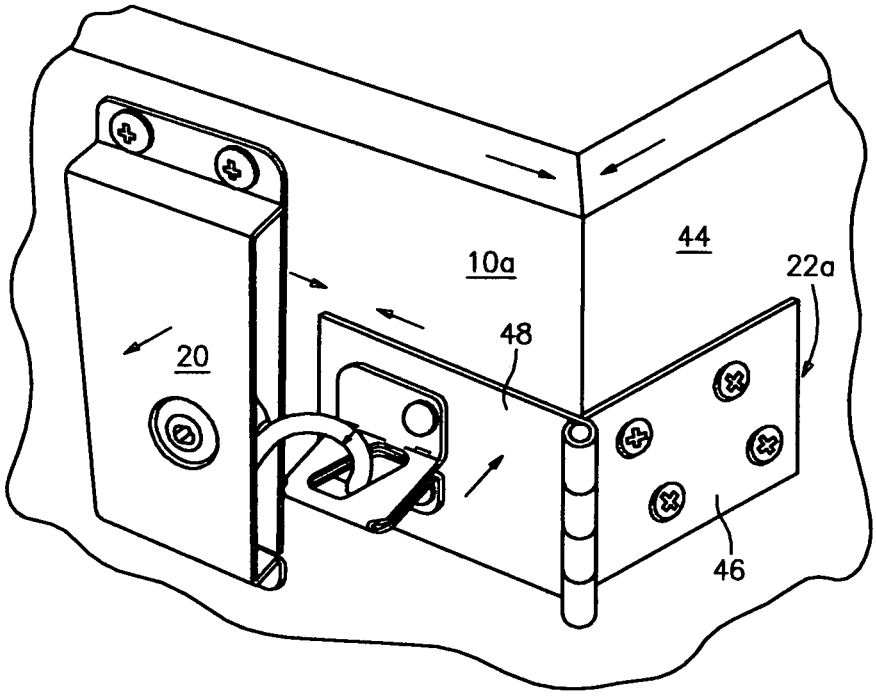
FIG. 5 is a perspective view of a fastener mechanism with a hinged anchor device.
Figure 7:
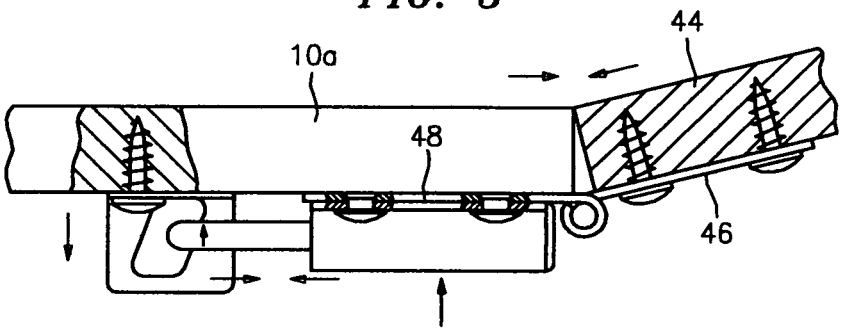
FIG. 7 is a top view of the fastener mechanism of FIG. 5.
Figure 8:
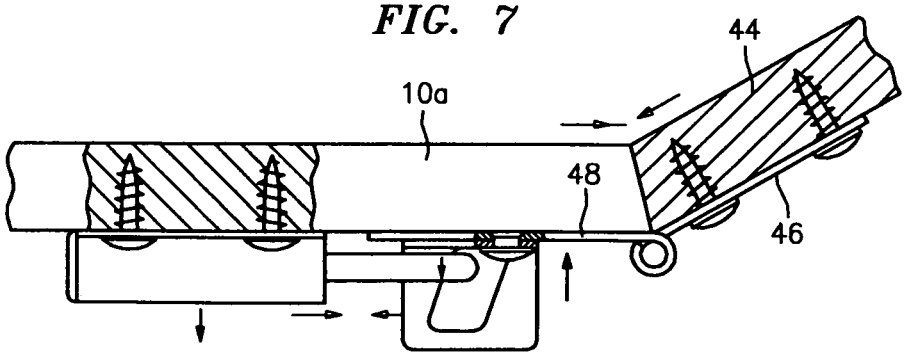
FIG. 8 is top view similar to FIG. 6 but with the fastener and anchor devices in reversed positions.

Referring to FIGS. 5, 7 and 8, a shutter 10*a* is shown associated with an adjacent member 44 which make take the form of a right angularly arranged second shutter or a trim portion. To accommodate this arrangement, a conventional latching device 20 may be employed with a hinge-like anchor device 22*a*. A first part 46 of the anchor device maybe secured to the member 44 with a second part 48 positioned on the surface of the shutter 10*a* adjacent the latching device 20, or vice versa. The part 48 may be identical with the anchor device 22 of FIGS. 2 and 3 and operation of the fastener mechanism may also be identical with that described above. With the hinge element 46 shown, various angles other than ninety degrees between the shutter 10 and the member 44 may of course be accommodated.

Figure 6:
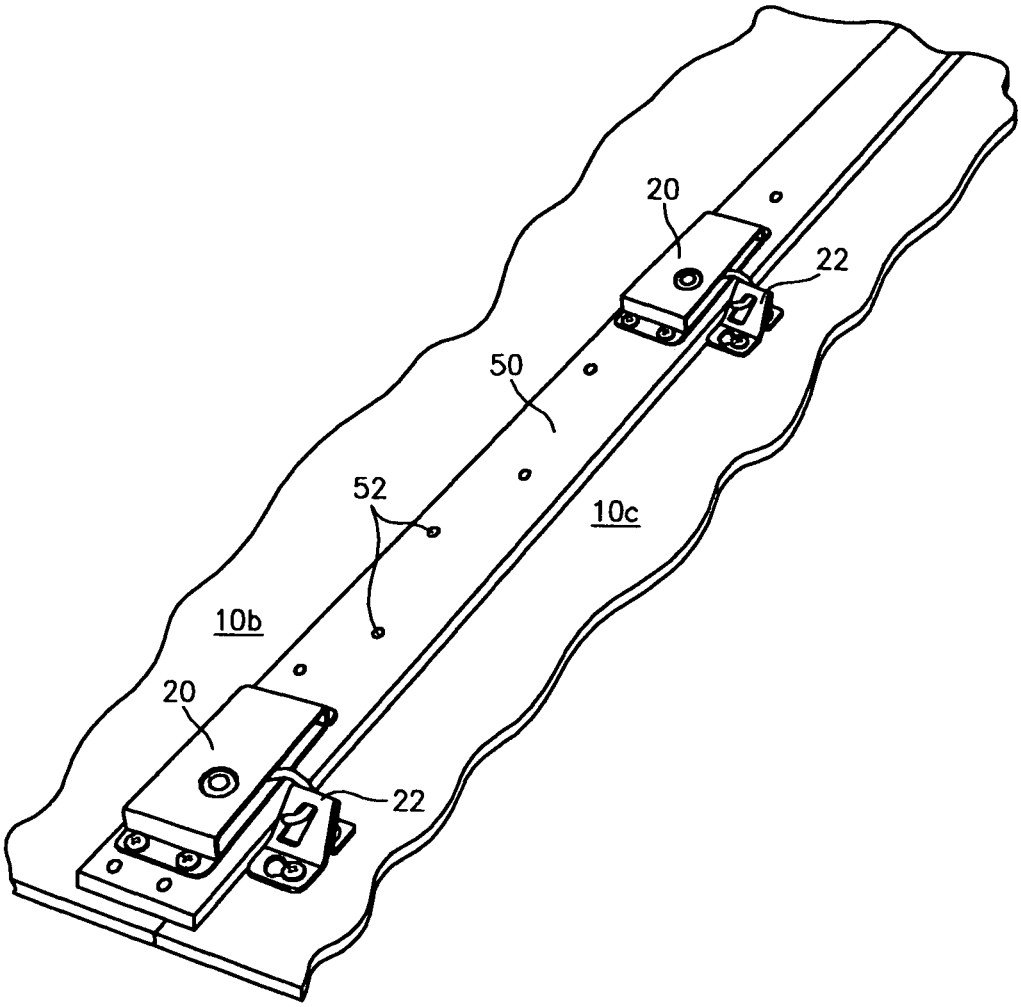
FIG. 6 is a perspective view of a pair of fastener mechanisms and a batten connecting adjacent shutters.

In FIG. 6 a pair of shutters 10*b* and 10*c* are arranged in abutting relationship in a common plane with a batten 50 positioned over the joint between the shutters. The batten 50 is shown mounted on the shutter 10*b* by means of screws 52, 52. A pair latching devices 20, 20 spaced along the batten 50 co-operate with anchor devices 22, 22 to secure the shutters 10*b* and 10*c* in firm abutting and sealed relationship, the batten 50 being urged in a perpendicular direction for firm engagement with the shutter 10*c* by the aforementioned derivative force perpendicular to the shutters.

Another aspect of the present invention resides in the provision of an installation method comprising the steps of providing a shutter with at least one latching device mounted thereon so as to project beyond the edge in a latching operation. The latching device has a rearwardly exposed operation means and the shutter has a small opening aligned with the operating means. An anchor device on an adjacent trim portion cooperates with the latching device. The shutter is positioned over a window or the like to be protected and the operating means is actuated from inside the shutter through the small aligned opening, the latching device thus engaging the anchor device and securing the shutter in place.

A further step in the method resides in proving a vertical support means for temporarily holding the shutter while the latching device is engaged with the anchor device.

Still another aspect of the invention, resides in the one man procedure with the installer passing the shutter outwardly through an open window or the like and thereafter positioning and securing the same in place as aforesaid.

The invention claimed is:

1. A fastener mechanism comprising, at least one latching device configured to be mounted on a window trim portion or a shutter; and at least one anchor device corresponding to the at least one latching device and configured to be mounted on the other of the window trim portion or the shutter, wherein, when unlatched, the at least one latching device and the at least one anchor device are adapted to not extend beyond an edge of the window trim portion or an edge of the shutter, wherein, when latched, the at least one latching device is configured to exert a latching force parallel to the plane of the shutter and window trim portion against the corresponding at least one anchor device, and wherein the at least one latching device or the at least one anchor device is configured to convert a portion of the parallel latching force to a perpendicular force, wherein the at least one latching device comprises a spring member having a latching hook at a free end, and wherein the at least one anchor device comprises an inclined surface configured to be engaged by the latching hook of the corresponding latching device.

2. The fastener mechanism of claim 1, wherein the at least one latching device is configured to exert as much as a 500 pound force on the at least one anchor device when latched.

3. The fastener mechanism of claim 1, wherein the inclined surface of the at least one anchor device is configured to convert the portion of the parallel latching force to the perpendicular force.

4. The fastener mechanism of claim 1, wherein the inclined surface comprises:

a receiving member having an inclined slot configured to receive the latching hook.

5. The fastener mechanism of claim 1, wherein the at least one latching device comprises:

a front side adapted to face exterior to the shutter and/or window trim portion surface;

a rear side adapted to face the surface of the shutter or window to which the latching device is mounted; and an operating device configured to be operated from the rear side of the latching device.

6. The fastener mechanism of claim 5, wherein the operating device comprises a socket operating device configured to allow manual operation of the fastener mechanism.

7. The fastener mechanism of claim 5, wherein the operating device is further configured to be operated from the front side of the latching device.

8. The fastener mechanism of claim 1, wherein the at least one anchor device comprises a hinge.

9. The fastener mechanism of claim 8, wherein the hinge is configured to allow mounting of the anchor device at various angles with respect to the plane of the shutter.

10. The fastener mechanism of claim 1, further comprising:

at least one hanger configured to hang the shutter from a portion of the window trim portion.

11. A fastener mechanism, comprising:

at least one latching device comprising a spring member having a latching hook at a free end configured to be mounted on a window trim portion or a shutter; and at least one anchor device corresponding to the at least one latching device and configured to be mounted on the other of the window trim portion or the shutter, the at least one anchor device comprising an inclined surface configured to be engaged by the latching hook of the corresponding latching device, wherein, when unlatched, the at least one latching device and the at least one anchor device are adapted to not extend beyond an edge of the window trim portion or an edge of the shutter, wherein, when latched, the at least one latching device is configured to exert a latching force parallel to the plane of the shutter and window trim portion against the corresponding at least one anchor device, and wherein the at least one latching device or the at least one anchor device is configured to convert a portion of the parallel latching force to a perpendicular force.

12. The fastener mechanism of claim 11, wherein the inclined surface of the at least one anchor device is configured to convert the portion of the parallel latching force to the perpendicular force.

13. The fastener mechanism of claim 11, wherein the inclined surface comprises:

a receiving member having an inclined slot configured to receive the latching hook.

14. The fastener mechanism of claim 11, wherein the at least one latching device comprises:

a front side adapted to face exterior to the shutter and/or window trim portion surface;

a rear side adapted to face the surface of the shutter or window to which the latching device is mounted; and an operating device configured to be operated from the rear side of the latching device.

15. The fastener mechanism of claim 11, wherein the hinge is configured to allow mounting of the anchor device at various angles with respect to the plane of the shutter.

16. The fastener mechanism of claim 11, further comprising:

at least one hanger configured to hang the shutter from a portion of the window trim portion.

* * * * *